US005845658A

United States Patent [19]

Sussman

[11] Patent Number: 5,845,658

[45] Date of Patent: Dec. 8, 1998

[54] COSMETIC TRAVEL COMPACT

[76] Inventor: Morris Sussman, 50 Doxsee Dr., Freeport, N.Y. 11520

[21] Appl. No.: 944,729

[22] Filed: Oct. 6, 1997

[51] Int. Cl.[6] ..... F22B 31/00

[52] U.S. Cl. ..... 132/287; 132/294; 132/301

[58] Field of Search ..... 132/287, 293, 132/294, 301, 303, 304; 206/581, 235, 823; 220/503, DIG. 26, 293, 298

[56] References Cited

U.S. PATENT DOCUMENTS

| | | | |
|---|---|---|---|
| 1,498,475 | 6/1924 | Mosheim | 132/287 |
| 1,662,065 | 3/1928 | Kendall | 13/287 |
| 1,701,860 | 2/1929 | Mullen | 132/294 |
| 2,401,127 | 5/1946 | Younghusband | 220/DIG. 26 |
| 2,421,646 | 6/1947 | Pepin | 132/305 |
| 2,452,230 | 10/1948 | Derham | 220/293 |
| 4,006,837 | 2/1977 | Gates et al. | 220/293 |
| 4,944,402 | 7/1990 | Wu | 206/581 |
| 4,972,860 | 11/1990 | Yuhara et al. | 132/301 |
| 5,074,572 | 12/1991 | Delmerico | 220/298 |
| 5,165,603 | 11/1992 | Hahn | 206/823 |
| 5,542,561 | 8/1996 | Slink et al. | 132/293 |
| 5,669,400 | 9/1997 | Sheffler et al. | 206/581 |
| 5,709,232 | 1/1998 | Sheffler et al. | 206/581 |

*Primary Examiner*—Todd E. Manahan
*Attorney, Agent, or Firm*—Michael Ebert

[57] ABSTRACT

A cosmetic travel compact in the form of a box-like package having a square base section and a square cover section adapted to supply a user with a facial cosmetic, an applicator therefor and a mirror viewable by the user when applying the cosmetic, all of which are protectively enclosed within the closed compact. The base section is provided with a drawer having a well therein to receive a powder puff and a platform mounted above the drawer on which a cylindrical shell is anchored to accommodate a pressed powder supply. Mounted within the cover section is a ring having a mirror nested therein, the ring screwing onto the shell to seal the powder supply when the cover section is seated on the platform and then turned to align the square of the cover section with that of the base section.

5 Claims, 2 Drawing Sheets

FIG. 1
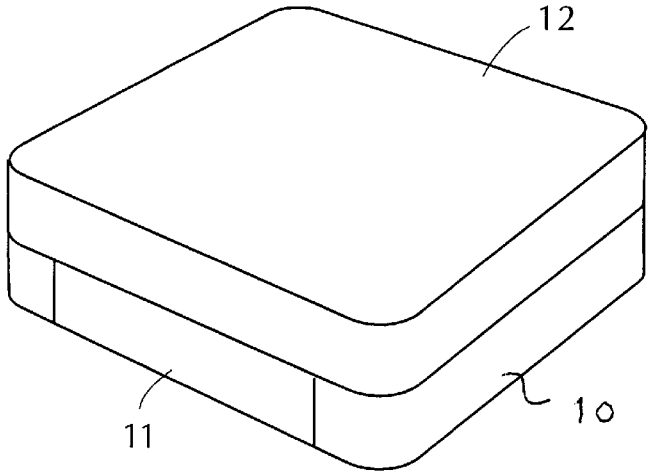
FIG. 2
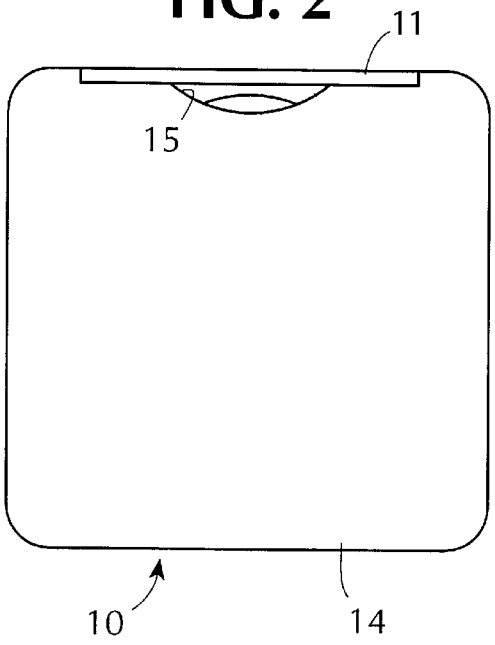
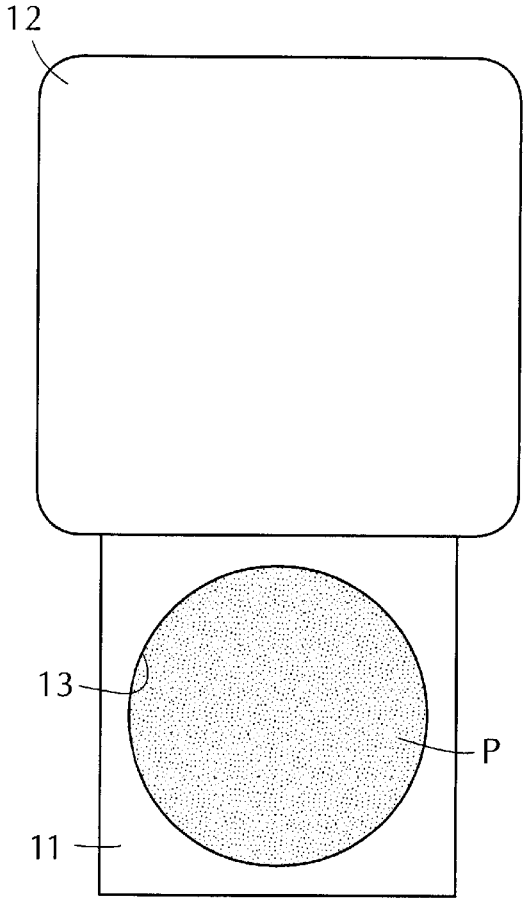
FIG. 3

COSMETIC TRAVEL COMPACT

BACKGROUND OF INVENTION

1. Field of Invention

This invention relates generally to compacts for cosmetics, and more particularly a travel compact which provides a user with a box-like package containing a facial powder cosmetic, an applicator therefor and a mirror.

2.Status of Prior Art

The typical facial powder compact takes the form of an oyster-shaped container having a supply of pressed powder and a hinged lid on whose inner wall is mounted a small mirror.

The cosmetic compact disclosed in the Tsuji et al. U.S. Pat. No. 4,526,273, includes a box-like hollow case, one end of which is open to receive a sliding drawer containing compacted face powder. Attached to the outer face of the top wall of the case is a mirror that is always exposed regardless of whether the drawer is pushed in or pulled out. Hence the mirror remains unprotected even when the compact is shut and is being transported. This mirror is not only subject to breakage, but also tends to gather dirt on its surface.

The Lombardi Jr. U.S. Pat. No. 5,163,457 discloses a travel compact having a rectangular case and a drawer therein for housing a cosmetic supply and a mirror, both of which in a storage mode of the compact are encased therein. The cosmetic supply and the mirror are both exposed in a utility mode whereby the user may then view her face as she applies the cosmetic thereto.

In order to apply a cosmetic facial powder to the face, the usual applicator for this purpose is a powder puff of round shape. The compacts disclosed in the above-identified Tsuji et al. and Lombardi patents do not include a powder puff. Hence the user who travels with these compacts must also take along, in a separate package, a powder puff.

In a compact containing a pressed powder pad it is not feasible to store a powder puff directly over the pad, for to do so would soil the pad with contaminants picked up by the puff in the course of its repeated use. It is known however to provide a compact with side-by-side compartments, one containing a pressed powder pad, the other a powder puff. But a compact in this form is relatively large and bulky and cannot be conveniently carried in a typically crowded woman's purse.

SUMMARY OF INVENTION

In view of the foregoing, the main object of this invention is to provide a travel compact which supplies its user in a single small package with a facial cosmetic, an applicator therefor and a mirror in which the user can see her face as she applies the cosmetic thereto.

More particularly, an object of this invention is to provide a travel compact of the above type in which the single package is created by a sectioned square box enclosing a cosmetic, an applicator therefor and a mirror.

A significant advantage of a travel compact in accordance with the invention is that the cosmetic pressed powder supply is in the form of a circular pad, the applicator therefor is in the form of a circular puff, and the mirror for seeing the face of the user is also circular—the puff, the pad and the mirror being superposed one above the other in the compact, thereby minimizing space requirements.

Also an object of this invention is to provide a travel compact that operates efficiently and can be mass-produced at low cost.

Briefly stated, these objects are attained by a cosmetic travel compact in the form of a box-like package having a square base section and a square cover section adapted to supply a user with a facial cosmetic, an applicator therefor and a mirror viewable by the user when applying the cosmetic, all of which are protectively enclosed within the closed compact.

The base section is provided with a pull out drawer having a well therein to receive a powder puff and a platform mounted above the drawer on which is anchored a cylindrical shell accommodating a pressed powder supply. Mounted within the cover section is a ring having a mirror nested therein, the ring screwing onto the shell to seal the powder supply when the cover section is seated on the platform and then turned to align the square of the cover section with that of the base section.

BRIEF DESCRIPTION OF DRAWINGS

For a better understanding of the invention, as well as other objects and features thereof, reference is made to the accompanying drawings wherein:

FIG. 1 is a perspective view of a travel compact in accordance with the invention in its closed state;

FIG. 2 is a bottom view of the compact;

FIG. 3 shows the pull-out drawer of the compact pulled open;

DESCRIPTION OF DRAWING

Figure 5:
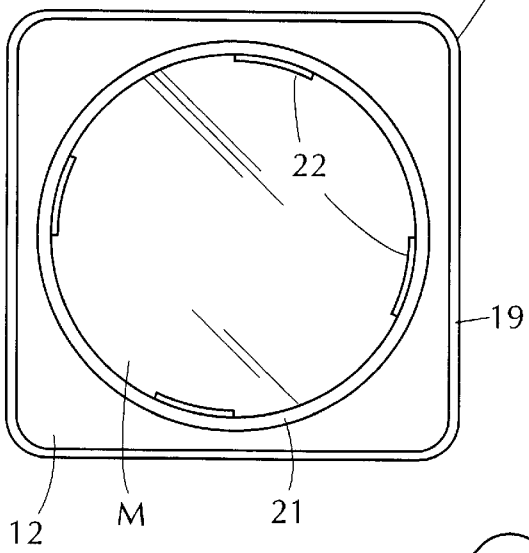
FIG. 5 illustrates the interior of the cover section.

Referring now to FIGS. 1 and 2, shown in these figures is a cosmetic travel compact in accordance with the invention in the form of a box-like package. The package consists of a square base section 10 having a rectangular pull-out drawer 11, and a square cover section 12 that can be separated from the base section. When the compact is in its closed state, the square of the cover section as shown in FIG. 1, is then aligned with the square of the base section to form a small box whose corners are rounded.

The base and cover sections of the box are molded of high-strength synthetic plastic material such as polycarbonate or polypropylene. As best seen in FIGS. 2 and 3, pull-out drawer 11 is provided with a circular well 13 to snugly accommodate a circular powder puff P (see FIG. 6). The square bottom wall 14 of base section 10 has a finger notch 15 therein adjacent the front end of pull-out drawer 11 to permit a user who inserts a finger in this notch to engage the front end of the drawer to pull it out.

Figure 4:
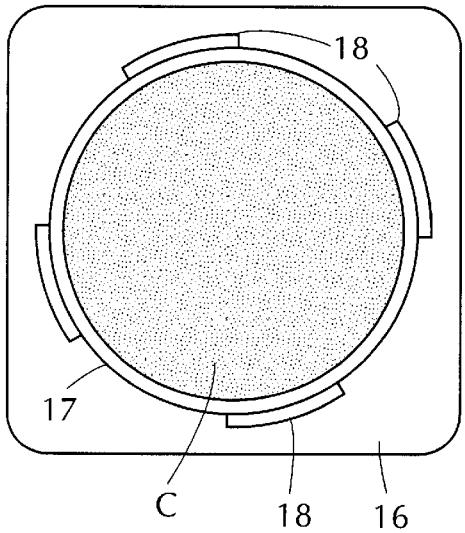
FIG. 4 shows the base section of the compact.
Figure 6:
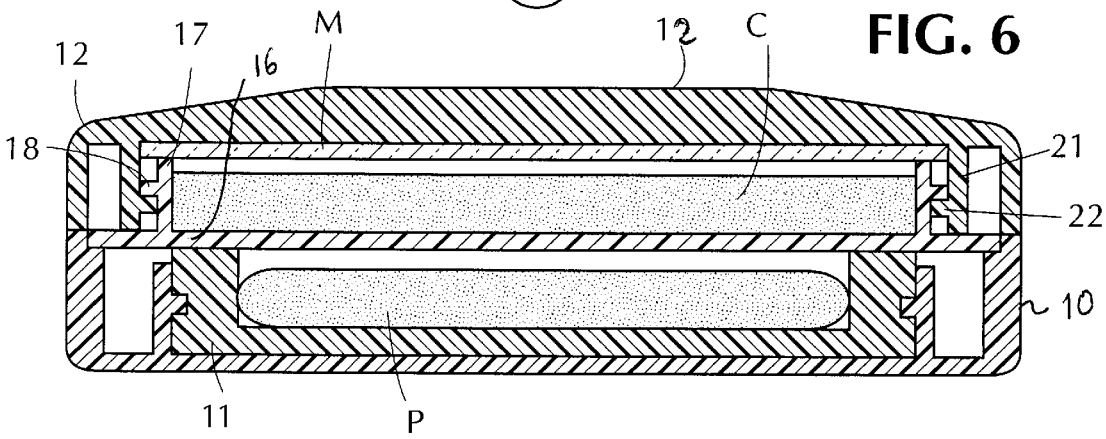
FIG. 6 is a transverse section taken through the closed compact.

As shown in FIG. 4, mounted above pull-out drawer in the base section 10 is a square platform 16 on which is anchored a circular shell 17. As shown in FIG. 6, received in shell 17 is a circular pad C of a pressed cosmetic powder providing the user of the compact with a powder supply. Formed on the outer circumference of shell 17 is a series of cams 18 to provide a thread engageable by cam followers formed on a ring mounted on the inside of cover 12.

Cover 12, as shown in FIG. 5, has formed along its periphery a square flange 19 which borders the main wall 20 of the cover section. Mounted on main wall 20 within the square flange is a circular ring 21 having nested therein a circular mirror M that is bonded to main wall 20. Formed on the outer circumference of ring 21 is a series of cam followers 22 which when cover section 12 is turned, then engage cams 18 on shell 17 anchored on platform 16 to provide a screw-like action which locks cover section 12 to base section 10.

The diameter of shell 17 relative to that of ring 21 is such that when cover section 12 is seated on platform 16, then as shown in FIG. 6, shell 17 telescopes within ring 21.

Figure 7:
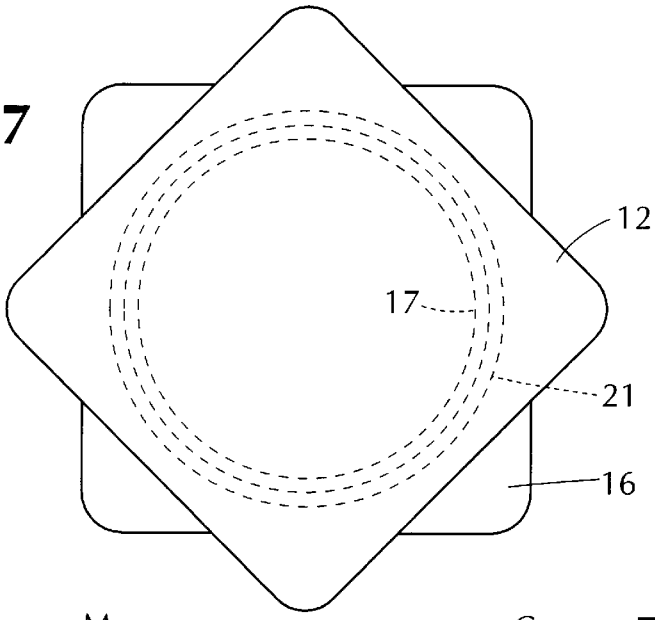
FIG. 7 illustrates the relationship of the square cover section to the square base section before the cover section is turned to align the square of the cover section with the square of the base section to close the compact.

To close the compact, one places cover section 12 on platform 16 of the base section 10 so that as shown in FIG. 7, the square of the cover section is angled with respect to the square of the base section. Shell 17 is then telescoped within ring 21 of the cover section so that the cover section is rotatable about the shell. Finally, the cover section 12 is turned to align the two squares, this action causing ring 21 to screw onto the shell and seal the cosmetic supply.

When the cosmetic supply in the compact includes a volatile agent, then in order to hermetically seal the supply to prevent the cosmetic from drying out, there is bonded to platform 16 an elastomeric sealing washer (not shown). When the ring of the cover section is screwed onto the shell of the base section, the circular exposed edge of the ring then engages and compresses the sealing washer to effect a hermetic seal.

It is important to note that when the compact is closed, confined therein is powder puff P, cosmetic supply C and mirror M. As shown in FIG. 6, these elements are supported in spaced relation one above the other within the compact, thereby reducing the space requirements of these elements yet preventing any contaminating interaction therebetween.

While there has been shown and described a preferred embodiment of a cosmetic travel compact in accordance with the invention, it will be appreciated that many changes may be made thereon without departing from the spirit of the invention.

I claim:

1. A cosmetic compact in the form of a box-like package, said compact comprising:

A. a square base section having vertical sides provided with a pull-out drawer for accommodating a cosmetic applicator, said section having a square platform mounted above the drawer on which is anchored an externally threaded cylindrical shell to receive a cosmetic supply;

B. a square cover section having vertical sides that when the compact is closed is seated on the platform, said cover section having mounted therein an internally-threaded ring that encircles and screws onto the shell to seal the cosmetic supply, the vertical sides of the cover section being aligned with the vertical sides of the base section when the compact is closed to create a box-like package; and C. an elastomeric washer bonded to said platform and surrounding the shell to effect a hermetic seal when the ring is screwed into the shell and then compresses the washer.

2. A cosmetic compact as set forth in claim 1, in which the base section and the cover section are both molded of synthetic plastic material.

3. A cosmetic compact as set forth in claim 1, in which said drawer is provided with a circular well in which is receivable a circular puff to apply said cosmetic.

4. A cosmetic compact as set forth in claim 1, further comprising a cosmetic supply disposed in said shell constituted by a circular pad of pressed powder.

5. A cosmetic compact as set forth in claim 1, further including a circular mirror nested in said ring.

* * * * *